US009745536B2

(12) United States Patent
Sakanoue et al.

(10) Patent No.: US 9,745,536 B2
(45) Date of Patent: Aug. 29, 2017

(54) LUBRICATING OIL COMPOSITION FOR SHOCK ABSORBER

(71) Applicant: IDEMITSU KOSAN CO., LTD., Chiyoda-ku (JP)

(72) Inventors: Shuichi Sakanoue, Chiba (JP); Aya Aoki, Sodegaura (JP)

(73) Assignee: IDEMITSU KOSAN CO., LTD., Chiyoda-ku (JP)

( * ) Notice: Subject to any disclaimer, the term of this patent is extended or adjusted under 35 U.S.C. 154(b) by 0 days.

(21) Appl. No.: 14/910,893

(22) PCT Filed: Aug. 25, 2014

(86) PCT No.: PCT/JP2014/072185
§ 371 (c)(1),
(2) Date: Feb. 8, 2016

(87) PCT Pub. No.: WO2015/025976
PCT Pub. Date: Feb. 26, 2015

(65) Prior Publication Data

US 2016/0186090 A1 Jun. 30, 2016

(30) Foreign Application Priority Data

Aug. 23, 2013 (JP) ..... 2013-173921

(51) Int. Cl.

| | |
|---|---|
| ***C10M 169/04*** | (2006.01) |
| ***C10M 137/10*** | (2006.01) |
| ***B01D 19/04*** | (2006.01) |
| ***C10M 133/06*** | (2006.01) |
| ***C10M 141/10*** | (2006.01) |
| ***C10M 161/00*** | (2006.01) |
| ***C10M 101/02*** | (2006.01) |
| ***C10M 155/02*** | (2006.01) |

(52) U.S. Cl.
CPC ..... *C10M 169/044* (2013.01); *C10M 101/02* (2013.01); *C10M 133/06* (2013.01); *C10M 137/10* (2013.01); *C10M 141/10* (2013.01); *C10M 155/02* (2013.01); *C10M 161/00* (2013.01); *C10M 2203/1006* (2013.01); *C10M 2203/1025* (2013.01); *C10M 2215/04* (2013.01); *C10M 2223/045* (2013.01); *C10M 2229/02* (2013.01); *C10M 2229/041* (2013.01); *C10M 2229/051* (2013.01); *C10N 2210/02* (2013.01); *C10N 2230/06* (2013.01); *C10N 2230/70* (2013.01); *C10N 2240/08* (2013.01)

(58) Field of Classification Search
CPC ..... C10M 2229/051; C10M 2223/045; C10M 2215/04
USPC ..... 508/206, 369, 545
See application file for complete search history.

(56) References Cited

U.S. PATENT DOCUMENTS

| | | | |
|---|---|---|---|
| 2006/0111255 | A1 | 5/2006 | Shirahama et al. |
| 2010/0075877 | A1 | 3/2010 | Koga |
| 2010/0105590 | A1 | 4/2010 | Nagakari et al. |

FOREIGN PATENT DOCUMENTS

| | | | |
|---|---|---|---|
| DE | 196 41 620 | | 4/1997 |
| JP | 59-71395 | A | 4/1984 |
| JP | 5-255682 | A | 10/1993 |
| JP | 5-255683 | A | 10/1993 |
| JP | 5-331478 | A | 12/1993 |
| JP | 2005-314609 | A | 11/2005 |
| JP | 2006-143925 | A | 6/2006 |
| JP | 2008-214618 | A | 9/2008 |
| WO | 2008/038667 | A1 | 4/2008 |
| WO | 2009/008327 | A1 | 1/2009 |
| WO | 2011/037054 | A1 | 3/2011 |

OTHER PUBLICATIONS

International Search Report issued Nov. 18, 2014 in PCT/JP2014/072185 filed Aug. 25, 2014.
Supplementary European Search Report issued Jan. 9, 2017 in connection with European Patent Application No. 14 83 7876, filed Aug. 25, 2014.

*Primary Examiner* — Vishal Vasisth
(74) *Attorney, Agent, or Firm* — Oblon, McClelland, Maier & Neustadt, L.L.P.

(57) ABSTRACT

The lubricating oil composition for a shock absorber of the present invention contains (A) a base oil composed of a mineral oil and/or a synthetic oil, (B) a tertiary amine represented by the following general formula (I), and (C) a zinc dithiophosphate represented by the following general formula (II):

(I)

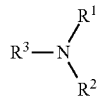

wherein $R^1$ and $R^2$ each independently represent an aliphatic hydrocarbon group having from 1 to 5 carbon atoms, and $R^3$ represents an aliphatic hydrocarbon group having from 12 to 24 carbon atoms in the general formula (I), (II)

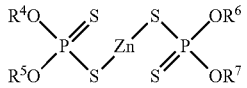

wherein $R^4$ to $R^7$ each independently represent one selected from an alkyl group and an alkenyl group each having 1 to 24 carbon atoms in the general formula (II).

10 Claims, No Drawings

LUBRICATING OIL COMPOSITION FOR SHOCK ABSORBER

This application is a 371 of PCT/JP2014/072185, filed Aug. 25, 2014.

TECHNICAL FIELD

The present invention relates to a lubricating oil composition for a shock absorber, in particular, to a lubricating oil composition for a shock absorber that is for use for a shock absorber for cars.

BACKGROUND ART

In a body of cars and the like, used is a suspension integrated with a shock absorber for reducing the vibration of the body caused by road surface roughness, the shaking thereof which occurs in quick acceleration or sudden braking, and the like. The structure of the shock absorber is based on a cylindrical structure that utilizes the resistance of oil to flow. Specifically, used is the structure having small holes bored in a hydraulic piston. In the slide part between the cylinder and the piston rod, a bush is provided to be a bearing. In general, the bush is formed of bronze.

During expansion and contraction movement, a shock absorber may receive a great lateral force, and in the case, friction is generated in a bush. The generation of friction may be a factor to worsen the riding comfort performance, and therefore it is desired to reduce the friction.

Heretofore, for reducing the friction generated in a bush, it has been investigated to blend a higher fatty acid such as stearic acid, isostearic acid or the like in a lubricating oil composition for a shock absorber. However, though a linear higher fatty acid such as stearic acid or the like could realize friction reduction for bronze, the corrosiveness thereof to bronze is high and the wear-resistant properties could not be therefore bettered, and further, the solubility in a base oil is low, which may often cause precipitates. On the other hand, a branched higher fatty acid such as isostearic acid or the like could have a high solubility in a mineral oil but could not sufficiently realize friction reduction for bronze, and further has a problem in that the wear-resistant properties could not be bettered. Namely, heretofore, suitable friction reduction for bronze-made bushes could not be realized by the use of a higher fatty acid.

In addition, heretofore known is a lubricating oil composition for a shock absorber, in which a phosphorus acid ester as an extreme-pressure agent is blended and a secondary amine is further blended, for example, as shown in PTL 1. However, this lubricating oil composition could not still sufficiently reduce the friction to bronze-made bushes.

Further, for example, in PTL 2, it is known to blend a tertiary amine in a lubricating oil composition for continuously-variable transmissions, along with an extreme-pressure agent composed of a phosphorus acid ester and a metal compound such as a metal sulfonate or the like. However, when this lubricating oil composition is used in a shock absorber without modifying, the friction coefficient for bronze-made bushes could not still be sufficiently reduced.

CITATION LIST

Patent Literature

PTL 1: WO 2008/038667 A1
PTL 2: WO 2011/037054 A1

SUMMARY OF INVENTION

Technical Problem

The present invention has been made in consideration of the above-mentioned problems, and its object is to provide a lubricating oil composition for a shock absorber capable of realizing friction reduction for the bush in a shock absorber having a bronze-made bush while bettering the wear-resistant properties to the bush and bettering the solubility in base oil.

Solution to Problem

The present inventors have assiduously studied and, as a result, have found that, with blending a specific zinc dithiophosphate in a lubricating oil composition for a shock absorber in addition to a specific tertiary amine therein, while bettering the wear-resistant properties to bronze-made bushes and bettering the solubility in base oil, the lubricating oil composition can be provided that realizes friction reduction to the bushes, and have completed the present invention as described below.

(1) A lubricating oil composition for a shock absorber, containing (A) a base oil composed of a mineral oil and/or a synthetic oil, (B) a tertiary amine represented by the following general formula (I), and (C) a zinc dithiophosphate represented by the following general formula (II).

(I)

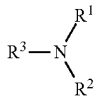

$R^1$ and $R^2$ each independently represent an aliphatic hydrocarbon group having from 1 to 5 carbon atoms, and $R^3$ represents an aliphatic hydrocarbon group having from 12 to 24 carbon atoms in the general formula (I).

(II)

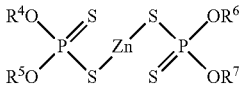

$R^4$ to $R^7$ each independently represent one selected from a linear, branched or cyclic alkyl group having from 1 to 24 carbon atoms and a linear, branched or cyclic alkenyl group having from 1 to 24 carbon atoms in the general formula (II).

(2) The lubricating oil composition for a shock absorber according to the above (1), further containing (D) a silicone foaming agent.

(3) The lubricating oil composition for a shock absorber according to the above (2), wherein the silicone foaming agent (D) is a polydimethylsiloxane having a kinematic viscosity at 20° C. of from 0.5 to 15 $mm^2/s$.

(4) The lubricating oil composition for a shock absorber according to the above (2) or (3), further containing (E) a silicone antifoaming agent.

(5) The lubricating oil composition for a shock absorber according to the above (4), wherein the silicone antifoaming agent (E) is a fluorinated polysiloxane having a kinematic viscosity at 20° C. of from 200 to 2,000 $mm^2/s$.

(6) The lubricating oil composition for a shock absorber according to any of the above (1) to (5), wherein $R^1$ and $R^2$ in the general formula (I) each are independently selected from a linear, branched or cyclic alkyl group having from 1 to 5 carbon atoms and a linear, branched or cyclic alkenyl group having from 1 to 5 carbon atoms, and $R^3$ is selected from a linear, branched or cyclic alkyl group having from 12 to 24 carbon atoms and a linear, branched or cyclic alkenyl group having from 12 to 24 carbon atoms.

(7) The lubricating oil composition for a shock absorber according to the above (6), wherein $R^3$ in the general formula (I) is a linear, branched or cyclic alkyl group having from 16 to 20 carbon atoms.

(8) The lubricating oil composition for a shock absorber according to the above (7), wherein $R^3$ in the general formula (I) is a stearyl group.

(9) The lubricating oil composition for a shock absorber according to any of the above (1) to (8), which contains from 0.01 to 3% by mass of the tertiary amine (B).

(10) The lubricating oil composition for a shock absorber according to any of the above (1) to (9), wherein $R^4$ to $R^7$ in the general formula (II) each are independently a linear, branched or cyclic alkyl group having from 6 to 10 carbon atoms.

(11) The lubricating oil composition for a shock absorber according to any of the above (1) to (10), which contains from 0.01 to 3% by mass of the zinc dithiophosphate (C).

(12) The lubricating oil composition for a shock absorber according to any of the above (1) to (11), which is a lubricating oil composition for a shock absorber for cars.

(13) The lubricating oil composition for a shock absorber according to any of the above (1) to (12), wherein $R^1$ and $R^2$ in the general formula (I) each have 1 or 2 carbon atoms.

Advantageous Effects of Invention

According to the present invention, there can be provided a lubricating oil composition for a shock absorber capable of realizing friction reduction for bushes while bettering the wear-resistant properties to bronze-made bushes and bettering the solubility in base oil.

DESCRIPTION OF EMBODIMENTS

The present invention is described below in more detail.

The lubricating oil composition for a shock absorber of the present invention contains (A) a base oil, (B) a tertiary amine and (C) a zinc dithiophosphate. The components are described below in detail.

[(A) Base Oil]

As the base oil in the lubricating oil composition for a shock absorber of the present invention, usable are mineral oil and/or synthetic oil.

Examples of the mineral oil include paraffin-based mineral oil, intermediate-based mineral oil, naphthene-based mineral oil and the like, which are obtained by usual refining processes such as solvent refining, hydrorefining or the like, those prepared by isomerizing wax produced through Fischer-Tropsch process or the like (gas-to-liquid wax) or mineral oil-based wax, and the like.

Examples of the synthetic oil include hydrocarbon synthetic oil, ether synthetic oil, etc. As examples of the hydrocarbon synthetic oil, there are mentioned α-olefin oligomers such as polybutene, polyisobutylene, 1-octene oligomer, 1-decene oligomer, ethylene-propylene copolymer, etc. and hydrides thereof; alkylbenzene, alkylnaphthalene, etc. Examples of the ether synthetic oil include polyoxyalkylene glycol, polyphenyl ether, etc.

As the base oil, one alone of the above-mentioned mineral oil and/or the above-mentioned synthetic oil may be used, or two or more of them may be used.

Further, a combination of at least one mineral oil and at least one synthetic oil may be used.

As the base oil, preferred is a mineral oil among the above, from the viewpoint of the solubility of additives therein.

The kinematic viscosity of the base oil is not specifically limited. However, in the case where the lubricating oil composition for a shock absorber of the present invention is used as a shock absorber oil for cars for example, the kinematic viscosity at 40° C. thereof is preferably from 2 to 20 $mm^2/s$, more preferably from 5 to 14 $mm^2/s$. In the case where two or more of mineral oil and/or synthetic oil are used, the above numerical values mean the kinematic viscosity of the base oil of the mixture thereof.

The content ratio of the base oil (A) in the total amount of the lubricating oil composition for a shock absorber is preferably from 80 to 99% by mass, more preferably from 90 to 96% by mass.

[(B) Tertiary Amine]

The tertiary amine for use in the lubricating oil composition for a shock absorber of the present invention is represented by the following general formula (I).

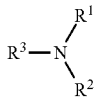

(I)

In the general formula (I), $R^1$ and $R^2$ each independently represent an aliphatic hydrocarbon group having from 1 to 5 carbon atoms, and $R^3$ represents an aliphatic hydrocarbon group having from 12 to 24 carbon atoms.

In the general formula (I), preferably, $R^1$ and $R^2$ each independently represent a linear, branched or cyclic alkyl group having from 1 to 5 carbon atoms or a linear, branched or cyclic alkenyl group having from 1 to 5 carbon atoms. $R^1$ and $R^2$ may be different from each other or may be the same, but preferably, the two are the same. $R^3$ is preferably a linear, branched or cyclic alkyl group having from 12 to 24 carbon atoms or a linear, branched or cyclic alkenyl group having from 12 to 24 carbon atoms.

In the present invention, when the carbon number of $R^1$ and $R^2$ were larger than 5, the friction coefficient of the lubricating oil composition for bronze could not be sufficiently lowered. From this viewpoint, the carbon number of $R^1$ and $R^2$ is preferably smaller, and each carbon number is preferably 1 or 2, and each carbon number is most preferably 1. Further, from the viewpoint of enhancing the stability and further reducing the friction coefficient, more preferably, $R^1$ and $R^2$ are an alkyl group.

Specifically, examples of $R^1$ and $R^2$ include a methyl group, an ethyl group, a propyl group, a butyl group, a pentyl group, a vinyl group, a propenyl group, a butenyl group and a pentenyl group, and these may be linear, branched or cyclic. Among these, preferred are a methyl group and an ethyl group, and most preferred is a methyl group.

When the carbon number of $R^3$ in the tertiary amine (B) falls outside the above-mentioned range, there might occur some disadvantages, for example, the solubility in base oil worsens, or the friction coefficient to bronze could not sufficiently lower. From these viewpoints, the carbon number of $R^3$ is preferably from 16 to 20, more preferably 18.

Regarding the tertiary amine (B), the main component thereof is preferably a tertiary amine where $R^3$ has from 16 to 20 carbon atoms, and is more preferably a tertiary amine where the carbon number of the group is 18. The wording "the main component" means that the component is 50% by mass or more of the total amount of the tertiary amine (B), and the content ratio is preferably 80% by mass or more, more preferably 90% by mass or more.

For enhancing the stability and further lowering the friction coefficient, $R^3$ is preferably an alkyl group. Moreover, $R^3$ is preferably linear.

Examples of the alkyl group of $R^3$ include a dodecyl group, a tridecyl group, a tetradecyl group, a pentadecyl group, a hexadecyl group, a heptadecyl group, an octadecyl group, a nonadecyl group, an eicosyl group, a heneicosyl group, a docosyl group, a tricosyl group, and a tetracosyl group, and these may be linear, branched or cyclic. Examples of the alkenyl group include a dodecenyl group, a tridecenyl group, a tetradecenyl group, a pentadecenyl group, a hexadecenyl group, a heptadecenyl group, an octadecenyl group, a nonadecenyl group, an eicosenyl group, a heneicosenyl group, a docosenyl group, a tricosenyl group and a tetracosenyl group, and these may be linear, branched or cyclic, and in these, the double bond may be at any position.

Of those, preferred are a hexadecyl group, an octadecyl group such as a stearyl group, an octadecenyl group such as an oleyl group, an eicosyl group, etc., and most preferred is a stearyl group.

Preferred specific compounds of the tertiary amine (B) include dimethylmonostearylamine, diethylstearylamine, etc.

Preferably, the tertiary amine (B) is contained in an amount of from 0.01 to 3% by mass relative to the total amount of the lubricating oil composition for a shock absorber. Falling within the range, the tertiary amine can reduce the friction coefficient for bronze with the suitable amount. From this viewpoint, more preferably, the tertiary amine is contained in an amount of from 0.1 to 1.5% by mass relative to the total amount of the lubricating oil composition for a shock absorber.

[(C) Zinc Dithiophosphate]

The zinc dithiophosphate for use in the present invention is represented by the following general formula (II).

(II)

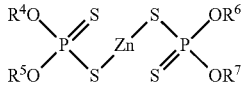

In the general formula (II), $R^4$ to $R^7$ each independently represent a linear, branched or cyclic alkyl group having from 1 to 24 carbon atoms or a linear, branched or cyclic alkenyl group having from 1 to 24 carbon atoms. These may be different from each other or may be the same, but from the viewpoint of easiness in production, these are preferably the same.

In the present invention, use of the zinc dithiophosphate along with the tertiary amine can favorably lower the friction coefficient of the lubricating oil composition to bronze, and can reduce the degree of vibration in the wear test to prevent stick-slip or the like thereby further bettering the riding comfort performance.

In the general formula (II), the carbon number of $R^4$ to $R^7$ is preferably from 6 to 10. When the carbon number in the zinc dithiophosphate is limited to fall within the range, the friction coefficient for bronze can be more effectively reduced. From this viewpoint, more preferably, these substituents include an alkyl group or an alkenyl group having a carbon number of 8, and most preferably, all those $R^4$ to $R^7$ are ones having a carbon number of 8. Also preferably, $R^4$ to $R^7$ are linear or branched, and furthermore from the viewpoint of stability and the like, preferred is an alkyl group.

Examples of the alkyl group of $R^4$ to $R^7$ include a methyl group, an ethyl group, a propyl group, a butyl group, a pentyl group, a hexyl group, a heptyl group, an octyl group, a nonyl group, a decyl group, an undecyl group, a dodecyl group, a tridecyl group, a tetradecyl group, a pentadecyl group, a hexadecyl group, a heptadecyl group, an octadecyl group, a nonadecyl group, an eicosyl group, a heneicosyl group, a docosyl group, a tricosyl group and a tetracosyl group, and these may be any of linear, branched or cyclic ones. Examples of the alkenyl group include a vinyl group, a propenyl group, a butenyl group, a pentenyl group, a hexenyl group, a heptenyl group, an octenyl group, a nonenyl group, a decenyl group, an undecenyl group, a dodecenyl group, a tridecenyl group, a tetradecenyl group, a pentadecenyl group, a hexadecenyl group, a heptadecenyl group, an octadecenyl group, a nonadecenyl group, an eicosenyl group, a heneicosenyl group, a docosenyl group, a tricosenyl group and a tetracosenyl group, and these may be any of linear, branched or cyclic ones, and the double bond may be at any position therein.

Of those, preferred are hexyl group, a heptyl group, an octyl group, a nonyl group and a decyl group, and especially preferred is an octyl group such as a 2-ethylhexyl group, etc.

Preferably, the zinc dithiophosphate (C) is contained in an amount of from 0.01 to 3% by mass relative to the total amount of the lubricating oil composition for a shock absorber. Falling within the above range, the zinc dithiophosphate (C) can reduce the friction to bronze and can better the wear-resistant properties to bronze with the suitable amount. From this viewpoint, more preferably, the zinc dithiophosphate (C) is contained in an amount of from 0.1 to 1.5% by mass relative to the total amount of the lubricating oil composition for a shock absorber.

[(D) Silicone Foaming Agent]

The lubricating oil composition for a shock absorber of the present invention preferably contains (D) a silicone foaming agent.

With blending a silicone foaming agent (D) therein, the lubricating oil composition for a shock absorber can generate foams not only in low-temperature environments but also in high-temperature environments. When foams are generated in the lubricating oil composition for a shock absorber, the riding comfort performance can be improved by the cushion performance of the foams.

The silicone foaming agent is preferably a polydimethylsiloxane. The polydimethylsiloxane is, for example, one represented by the following formula (III).

(III)

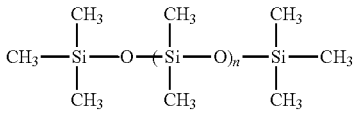

In the above formula (III), n is a positive integer and is a value corresponding to the viscosity. The kinematic viscosity at 20° C. of the silicone foaming agent (D) is preferably from 0.5 to 15 $mm^2/s$, more preferably from 1 to 10 $mm^2/s$, even more preferably from 3 to 8 $mm^2/s$. When the viscosity falls within the ranges, a sufficient foaming effect can be exhibited.

One alone or two or more types of polydimethylsiloxanes may be used either singly or as combined.

Preferably, the silicone foaming agent (D) is contained in an amount of from 0.001 to 0.1% by mass relative to the total amount of the lubricating oil composition for a shock absorber, more preferably from 0.005 to 0.05% by mass.

[(E) Silicone Antifoaming Agent]

Preferably, the lubricating oil composition for a shock absorber of the present invention contains (E) a silicone antifoaming agent in addition to the above-mentioned silicone foaming agent (D). The silicone antifoaming agent (E) is, for example, a fluorinated polysiloxane.

With containing the silicone antifoaming agent (E) in addition to the silicone foaming agent (D), the lubricating oil composition for a shock absorber can foam in the same foaming degree under conditions at both low temperatures and high temperatures, and the defoaming time can be adjusted in suitable one.

The fluorinated polysiloxane is, for example, represented by the following general formula (IV).

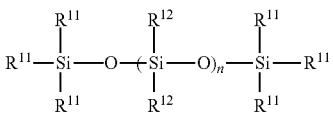

(IV)

In the above general formula (IV), n is a positive integer and is a value corresponding to the viscosity. $R^{11}$ each independently represents a hydrocarbon group or a fluorohydrocarbon group, and these may be the same as or different from each other. $R^{12}$ each independently represents a hydrocarbon group or a fluorohydrocarbon group, and these may be the same as or different from each other, and in different repeating units these may be the same as or different from each other. In the fluorinated polysiloxane, at least one of plural $R^{12}$'s is a fluorohydrocarbon group. Examples of the hydrocarbon group of $R^{11}$ and $R^{12}$ include those having from 1 to 10 carbon atoms, and specific examples thereof include an alkyl group such as a methyl group, an ethyl group, a propyl group, etc.; and an aryl group such as a phenyl group, etc; preferred is a polyfluoroalkylmethylsiloxane in which the group is a methyl group, from the viewpoint of the defoaming effect.

Examples of the fluorohydrocarbon group include a fluoroalkyl group having 10 or less carbon atoms, more specifically a trifluoropropyl group, etc.

Preferably, the silicone antifoaming agent (E) has a kinematic viscosity at 20° C. of from 200 to 2,000 $mm^2/s$, more preferably from 500 to 1,500 $mm^2/s$.

Having the viscosity falling within the range, foaming can be suppressed to thereby control the foaming amount on the same level under conditions in both low-temperature environments and high-temperature environments.

The content of the silicone antifoaming agent (E) is preferably smaller than that of the silicone foaming agent (D) relative to the total amount of the lubricating oil composition for a shock absorber, and specifically, the content is preferably from 0.0001 to 0.01% by mass, more preferably from 0.0005 to 0.003% by mass. The ratio by mass of the silicone foaming agent (D) to the silicone antifoaming agent (E) ([content of silicone foaming agent (D)]/[content of silicone antifoaming agent (E)]) in the lubricating oil composition for a shock absorber is, from the viewpoint of bettering the foaming characteristics, preferably from 2 to 20, more preferably from 5 to 15.

Preferably, the lubricating oil composition for a shock absorber of the present invention contains the above-mentioned silicone foaming agent (D) and silicone antifoaming agent (E), whereby the foaming characteristics are controlled to be within a predetermined range. Specifically, it is desirable that the initial foaming amount at 20° C. and 120° C. to be measured according to the measurement method to be mentioned below is from 100 to 150 ml. Having the initial foaming amount that falls within the range at the temperatures, the oil composition can better the riding comfort performance within a broad temperature range due to the cushion performance of the foams.

Also preferably, the defoaming time at 20° C., as measured according to the measurement method to be mentioned below, is preferably from 100 to 150 seconds, and also preferably, the defoaming time at 100° C. is shorter than 50 seconds. The defoaming times falling within these ranges are advantageous in that disturbance of the wave form of a damping force is not caused.

However, the lubricating oil composition for a shock absorber of the present invention is not always required to contain the silicone foaming agent (D) and the silicone antifoaming agent (E). For example, any other antifoaming agent than those mentioned above may be blended.

[Optional Additive Component]

The lubricating oil composition for a shock absorber of the present invention can suitably contain, as an optional additive component (F), at least one selected from viscosity index improvers, friction regulators and seal swellers within a range not detracting from the object of the present invention. Also if desired, this may contain any other additives heretofore generally used in lubricating oil compositions for a shock absorber, such as antioxidants, ash-less dispersants, metal-based detergents, rust preventive agents, metal de activators, pour-point depressants, etc.

The content ratio of the optional additive component (F) in the total amount of the lubricating oil composition for a shock absorber is, in general, preferably 15% by mass or less, more preferably from 3 to 10% by mass.

Examples of the viscosity index improver include polymethacrylate, dispersive polymethacrylate, olefinic copolymer (for example, ethylene-propylene copolymer., etc.), dispersive olefinic copolymer, styrenic copolymer (for example, styrene-diene hydrogenated copolymer, etc.), etc., and preferred are polymethacrylate.

Examples of the friction regulator include partial ester compounds to be obtained through reaction of a fatty acid and an aliphatic polyalcohol. The fatty acid is preferably a fatty acid having a linear or branched hydrocarbon group with from 6 to 30 carbon atoms, in which the carbon number of the hydrocarbon group is preferably from 8 to 24, more preferably from 10 to 20. Examples of the fatty acid include saturated fatty acids such as caproic acid, caprylic acid, capric acid, lauric acid, myristic acid, palmitic acid, stearic acid, arachic acid, behenic acid, lignoceric acid, etc., and unsaturated fatty acids such as myristoleic acid, palmitoleic acid, oleic acid, linoleic acid, etc.; and preferred is oleic acid. The aliphatic polyalcohol is a di- to hexa-alcohol, including ethylene glycol, glycerin, trimethylolpropane, pentaerythritol, sorbitol, etc. Preferred are pentaerythritol and glycerin. One alone or two or more of these partial ester compounds may be used either singly or as combined.

Examples of the antioxidant include monocyclic phenolic antioxidants such as 2,6-di-tert-butyl-p-cresol, 2,6-di-tert-butyl-4-ethylphenol, etc.; polycyclic phenolic antioxidants such as 4,4'-methylenebis(2,6-di-tert-butylphenol), 2,2'-methylenebis(4-ethyl-6-tert-butylphenol), etc.; amine-based antioxidants including monoalkyldiphenylamine compounds such as monooctyldiphenylamine, monononyldiphenylamine, etc., dialkyldiphenylamine compounds such as 4,4'-dibutyldiphenylamine, 4,4'-dipentyldiphenylamine, 4,4'-dihexyldiphenylamine, 4,4'-diheptyldiphenylamine, 4,4'-dioctyldiphenylamine, 4,4'-dinonyldiphenylamine, etc., polyalkyldiphenylamine compounds such as tetrabutyldiphenylamine, tetrahexyldiphenylamine, tetraoctyldiphenylamine, tetranonyldiphenylamine, etc., and naphthylamine compounds such as α-naphthylamine, phenyl-α-naphthylamine, butylphenyl-α-naphthylamine, pentylphenyl-α-naphthylamine, hexylphenyl-α-naphthylamine, heptylphenyl-α-naphthylamine, octylphenyl-α-naphthylamine, nonylphenyl-α-naphthylamine, etc.; and sulfur-containing antioxidants such as 2,6-di-tert-butyl-4-(4,6-bis(octylthio)-1,3,5-triazin-2-ylamino)phenol, thioterpene compounds including a reaction product of phosphorus pentasulfide and pinene, etc., dialkyl thiodipropionates including dilauroyl thiodipropionate, distearyl thiodipropionate, etc.

Examples of the ash-less dispersant include succinimides, boron-containing succinimides, benzylamines, boron-containing benzylamines, succinates, amides of mono or dicarboxylic acid typified by fatty acid or succinic acid. Examples of the metal-based detergent include neutral metal sulfonates, neutral metal phenates, neutral metal salicylates, neutral metal phosphonates, basic sulfonates, basic phenates, basic salicylates, overbased sulfonates, overbased salicylates, overbased phosphonates, etc. Examples of the rust preventive agent include metal-typed sulfonates, succinates, etc. Examples of the metal deactivator include benzotriazole, thiadiazole, etc. Examples of the pour-point depressant include polymethacrylate having a weight-average molecular weight of from 50,000 to 150,000 or so, etc.

The kinematic viscosity at 40° C. of the lubricating oil composition for a shock absorber of the present invention is, from the viewpoint of low-temperature flowability, preferably 18 $mm^2/s$ or less, more preferably from 2 to 15 $mm^2/s$.

With containing the predetermined tertiary amine (B) and zinc dithiophosphate (C), the lubricating oil composition for a shock absorber of the present invention as mentioned above can reduce the friction coefficient to bronze while keeping good wear-resistant properties to bronze and keeping good solubility of the tertiary amine (B) in the base oil.

The lubricating oil composition for a shock absorber of the present invention can be used in any of a multi-cylinder shock absorber and a single-cylinder shock absorber, and can be used in any shock absorbers for cars and motorcycles. Especially preferred is use for cars.

In addition, the lubricating oil composition for a shock absorber of the present invention is especially favorably used in a shock absorber having a bush whose inner wall being the slide face to a piston rod is at least formed of bronze such as phosphor bronze or the like.

The slide face of the piston rod to the bush is generally formed of chromium, for example, by chromium plating or the like.

Further, the lubricating oil composition for a shock absorber of the present invention can be also favorably used as a hydraulic oil for industrial use, a hydraulic oil for construction use, etc.

EXAMPLES

Next, the present invention is described in more detail by Examples, but the present invention is not whatsoever restricted by these Examples.

Evaluations of physical properties in the present invention were carried out according to the following methods.

[Evaluation Methods]

1. Kinematic Viscosity

Measured according to JIS K2283.

2. Friction Coefficient μ to Bronze

Using a Bowden type reciprocating friction tester, the friction coefficient μ to bronze was measured under the following test conditions.

Test Conditions

Temperature: 80° C.

Load: 0.5 kgf

Rate: 0.2 mm/s

Amplitude: 10 mm

Test piece: phosphor-bronze ball (ball having a diameter 12.7 mm)/chromium-plated plate (50×1,000×5 mm)

3. Worn Area

Using a Bowden type reciprocating friction tester, the worn area of bronze was measured according to a bronze wear test under the following test conditions.

Test Conditions

Temperature: 80° C.

Load: 0.5 kgf

Rate: 5 mm/s

Amplitude: 10 mm

Test piece: phosphor-bronze ball (ball having a diameter of 12.7 mm)/chromium-plated plate (50×1,000×5 mm)

Test time: 30 minutes

Measurement of the above friction coefficient μ and worn area was performed, after a few drops of a sample oil were put onto the plate and running-in operation (at a rate of 20 mm/s for 2 minutes) was performed.

4. Amplitude in Bronze Wear Test

In the above bronze wear test, the amplitude of the friction coefficient at the center position of displacement was measured.

5. Solubility

Various additives were added to the base oil at 60° C., and mixed to prepare a lubricating oil composition for a shock absorber. This was statically left at room temperature (23° C.) for 24 hours, and the appearance thereof was observed.

6. Foaming Characteristics Evaluation Test

Each lubricating oil composition for a shock absorber was stirred by jetting for 5 minutes, and then the foaming amount immediately after stopping the stirring was referred to as initial foaming. The time taken until the disappearance of the foams was referred to as a defoaming time. The foaming characteristics were evaluated at 20° C. and 100° C.

Examples 1 and 2 and Comparative Examples 1 to 4

Lubricating oil compositions for a shock absorber of Examples 1 and 2 and Comparative Examples 1 to 4 as shown in Table 1 were prepared, and evaluated for the friction coefficient μ to bronze, the worn area and the solubility.

TABLE 1

| | | Example 1 | Example 2 | Comparative Example 1 | Comparative Example 2 | Comparative Example 3 | Comparative Example 4 |
|---|---|---|---|---|---|---|---|
| Lubricating Oil Composition | (A) Base Oil 1 | 93.589 | 93.589 | 93.599 | 93.599 | 94.099 | 94.099 |
| | (B) Tertiary Amine 1 | 0.500 | — | — | — | — | — |
| | (B) Tertiary Amine 2 | — | 0.500 | — | — | — | — |
| | Stearic Acid | — | — | 0.500 | — | — | — |
| | Isostearic Acid | — | — | — | 0.500 | — | — |
| | Dioleyl Acid Phosphate | — | — | — | — | 0.800 | — |
| | Distearyl Acid Phosphate | — | — | — | — | — | 0.800 |
| | (C) Zinc Dithiophosphate | 0.800 | 0.800 | 0.800 | 0.800 | — | — |
| | (D) Silicone Foaming Agent | 0.010 | 0.010 | — | — | — | — |
| | (E) Fluorinated Silicone Antifoaming Agent | 0.001 | 0.001 | — | — | — | — |
| | Silicone Antifoaming Agent | — | — | 0.001 | 0.001 | 0.001 | 0.001 |
| | Viscosity Index Improver | 1.400 | 1.400 | 1.400 | 1.400 | 1.400 | 1.400 |
| | Sulfur-Based Seal Sweller | 0.400 | 0.400 | 0.400 | 0.400 | 0.400 | 0.400 |
| | Pentaerythritol Dioleate (friction regulator) | 3.000 | 3.000 | 3.000 | 3.000 | 3.000 | 3.000 |
| | Monooleyl Glyceride (friction regulator) | 0.300 | 0.300 | 0.300 | 0.300 | 0.300 | 0.300 |
| Evaluation Results | 40° C. Kinematic Viscosity of Composition | 12.1 | 12.1 | 12.3 | 12.3 | 12.0 | 12.3 |
| | Friction Coefficient μ to Bronze | 0.072 | 0.075 | 0.054 | 0.280 | 0.140 | 0.240 |
| | Worn Area ($mm^2$) in Bronze Wear Test | 0.028 | 0.030 | 0.072 | 0.198 | 0.040 | 0.181 |
| | Amplitude in Bronze Wear Test | 0.001 | 0.001 | 0.001 | 0.001 | 0.005 | 0.008 |
| | Solubility in Mineral Oil | transparent | transparent | cloudy | transparent | transparent | transparent |

Mineral oil and additives in Tables 1 and 2 are as follows.

Base oil 1: paraffinic mineral oil, 40° C. kinematic viscosity: 9.067 $mm^2/s$, viscosity index: 109, density (15° C.): 0.828 $g/mm^3$.

Tertiary amine 1: dimethylstearylamine.

Tertiary amine 2: diethylstearylamine.

Zinc dithiophosphate: zinc 2-ethylhexyldithiophosphate of the general formula (II) where $R^4$ to $R^7$ are all 2-ethylhexyl.

Silicone foaming agent: polydimethylsiloxane having a 20° C. kinematic viscosity of 5 $mm^2/s$.

Fluorinated silicone antifoaming agent: fluorinated polysiloxane having a 20° C. kinematic viscosity of 1,000 $mm^2/s$.

Silicone antifoaming agent: polydimethylsiloxane having a 20° C. kinematic viscosity of 12500 $mm^2/s$.

Viscosity index improver: polymethacrylate compound.

Examples 1 to 6

Next, as shown in Table 2, lubricating oil compositions for a shock absorber of Examples 3 to 6 were prepared in addition to Examples 1 and 2, and evaluated for the solubility and the foaming characteristics thereof.

TABLE 2

| | | | Example 1 | Example 2 | Example 3 | Example 4 | Example 5 | Example 6 |
|---|---|---|---|---|---|---|---|---|
| Formulation | (A) Base Oil 1 | | 93.589 | 93.589 | 93.600 | 93.599 | 93.599 | 93.590 |
| | (B) Tertiary Amine 1 | | 0.500 | — | 0.500 | 0.500 | 0.500 | 0.500 |
| | (B) Tertiary Amine 2 | | — | 0.500 | — | — | — | — |
| | (C) Zinc Dithiophosphate | | 0.800 | 0.800 | 0.800 | 0.800 | 0.800 | 0.800 |
| | (D) Silicone Foaming Agent | | 0.010 | 0.010 | — | — | — | 0.010 |
| | (E) Fluorinated Silicone Antifoaming Agent | | 0.001 | 0.001 | — | — | 0.001 | — |
| | Silicone Antifoaming Agent | | — | — | — | 0.001 | — | — |
| | Viscosity Index Improver | | 1.400 | 1.400 | 1.400 | 1.400 | 1.400 | 1.400 |
| | Sulfur-Based Seal Sweller | | 0.400 | 0.400 | 0.400 | 0.400 | 0.400 | 0.400 |
| | Pentaerythritol Dioleate (friction regulator) | | 3.000 | 3.000 | 3.000 | 3.000 | 3.000 | 3.000 |
| | Monooleyl Glyceride (friction regulator) | | 0.300 | 0.300 | 0.300 | 0.300 | 0.300 | 0.300 |
| Evaluation Results | 40° C. Kinematic Viscosity of Composition | | 12.1 | 12.1 | 12.1 | 12.1 | 11.9 | 11.7 |
| | Solubility in Mineral Oil | | transparent | transparent | transparent | transparent | transparent | transparent |
| | Foaming Characteristics (20° C.) | Initial Foaming Amount (ml) | 120 | 125 | 250 | 62 | 61 | 221 |
| | | Defoaming Time (sec) | 125 | 128 | 52 | 232 | 26 | 121 |
| | Foaming Characteristics (100° C.) | Initial Foaming Amount (ml) | 121 | 122 | 211 | 262 | 21 | 312 |
| | | Defoaming Time (sec) | 21 | 23 | 31 | 52 | 12 | 80 |

As obvious from the results of Examples 1 and 2 in Table 1, by blending the tertiary amine (B) and the zinc dithiophosphate (C) in the base oil, the friction coefficient to bronze was lowered and the worn area was reduced, and therefore, the wear-resistant properties were bettered, and in addition, the solubility of various additives in mineral oil was good. On the other hand, when stearic acid was used in place of the tertiary amine (B), the friction coefficient was lowered, but the worn area was increased and thus the wear-resistant properties could not be bettered. Further, the solubility of the additives in the base oil was not sufficient. In addition, in Comparative Example 2 where isostearic acid was used in place of the tertiary amine (B), the wear-resistant properties could not be bettered and the friction coefficient μ could not be reduced sufficiently. Further, also in Comparative Examples 3 and 4 using a phosphate in place of the tertiary amine (B) and the zinc dithiophosphate (C), neither the friction coefficient nor the worn area could be lowered.

As obvious from the results of Examples 1 and 2 in Table 2, by blending the silicone foaming agent (D) and the silicone antifoaming agent (E), the initial foaming amount at each of 20° C. and 100° C. was controlled to fall within a range of from 100 to 150 ml, and further the defoaming time at each of 20° C. and 100° C. was controlled to be from 100 to 150 seconds, and shorter than 50 seconds, respectively. Thus, the oil compositions had good foaming characteristics. Consequently, it can be understood that the lubricating oil compositions for a shock absorber of Examples 1 and 2 can further better the riding comfort performance by foaming.

INDUSTRIAL APPLICABILITY

The lubricating oil composition for a shock absorber of the present invention can be used in various shock absorbers, and for example, can be favorably used in both a multi-cylinder shock absorber and a single-cylinder shock absorber, and in addition, can be used in shock absorbers for both cars and motorcycles. Especially preferred is use for cars.

The invention claimed is:

1. A lubricating oil composition for a shock absorber, comprising (A) a base oil composed of a mineral oil and/or a synthetic oil, (B) from 0.01 to 3% by mass of a tertiary amine represented by the following general formula (I), (C) from 0.01 to 3% by mass of a zinc dithiophosphate represented by the following general formula (II):

(I)

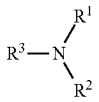

wherein $R^1$ and $R^2$ each independently represent an aliphatic hydrocarbon group having from 1 to 5 carbon atoms, and $R^3$ represents is a linear, branched or cyclic alkyl group having from 16 to 20 carbon atoms in the general formula (I), (II)

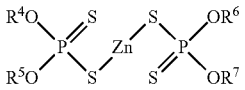

wherein $R^4$ to $R^7$ each independently represent one selected from a linear, branched or cyclic alkyl group having from 6 to 10 carbon atoms in the general formula (II), (D) from 0.001 to 0.1% by mass of a polydimethylsiloxane foaming agent having a kinematic viscosity at 20° C. of from 0.5 to 15 $mm^2/s$, and (E) from 0.0001 to 0.01% by mass of a fluorinated polysiloxane anti-foaming agent having a kinematic viscosity at 20° C. of from 200 to 2,000 $mm^2/s$.

2. The lubricating oil composition for a shock absorber according to claim 1, wherein $R^3$ in the general formula (I) is a stearyl group.

3. The lubricating oil composition for a shock absorber according to claim 1, which is a lubricating oil composition for a shock absorber for cars.

4. The lubricating oil composition for a shock absorber according to claim 1, wherein $R^1$ and $R^2$ in the general formula (I) each have 1 or 2 carbon atoms.

5. The lubricating oil composition for a shock absorber according to claim 1, wherein $R^1$ and $R^2$ each have one or two carbon atoms, and $R^3$ is a stearyl group in general formula (I).

6. The lubricating oil composition for a shock absorber according to claim 1, wherein the lubricating oil composition does not contain stearic acid.

7. The lubricating oil composition for a shock absorber according to claim 1, wherein the lubricating oil composition does not contain a non-fluorinated silicon antifoaming agent.

8. The lubricating oil composition for a shock absorber according to claim 1, having a friction coefficient μ to bronze of from 0.072 to 0.075.

9. The lubricating oil composition for a shock absorber according to claim 1, having a worn area in a bronze wear test of from 0.028 to 0.030 $mm^2$.

10. A shock absorber comprising the lubricating oil composition of claim 1.

* * * * *